US009811023B2

(12) United States Patent
Yamaguchi et al.

(10) Patent No.: US 9,811,023 B2
(45) Date of Patent: Nov. 7, 2017

(54) DEVELOPING DEVICE, IMAGE FORMING APPARATUS, AND TONER DETECTION METHOD

(71) Applicants: Akinori Yamaguchi, Osaka (JP); Naoki Nakatake, Hyogo (JP)

(72) Inventors: Akinori Yamaguchi, Osaka (JP); Naoki Nakatake, Hyogo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/531,049

(22) Filed: Nov. 3, 2014

(65) Prior Publication Data

US 2015/0125167 A1 May 7, 2015

(30) Foreign Application Priority Data

Nov. 6, 2013 (JP) ..... 2013-230720
Sep. 26, 2014 (JP) ..... 2014-197382

(51) Int. Cl.
*G03G 15/08* (2006.01)

(52) U.S. Cl.
CPC ..... *G03G 15/0831* (2013.01); *G03G 15/0889* (2013.01); *G03G 15/086* (2013.01)

(58) Field of Classification Search
CPC ..... G03G 15/08
USPC ..... 399/27
See application file for complete search history.

(56) References Cited

U.S. PATENT DOCUMENTS 5,532,790 A 7/1996 Akazawa
2007/0196147 A1* 8/2007 Nada ..... G03G 15/161 399/358
2008/0166145 A1* 7/2008 Watanabe ..... B41J 3/46 399/30
2012/0057889 A1 3/2012 Yamaguchi et al.
2012/0070166 A1* 3/2012 Endo ..... G03G 21/1889 399/27
2012/0189326 A1* 7/2012 Yoshida ..... G03G 15/0889 399/27
2013/0242318 A1 9/2013 Yamaguchi et al.
2013/0343775 A1 12/2013 Yamaguchi et al.
2014/0029962 A1* 1/2014 Shimizu ..... G03G 15/0831 399/27

FOREIGN PATENT DOCUMENTS

JP 06-149055 5/1994
JP 2005-134794 5/2005
JP 2012-051333 3/2012
JP 2013-064873 4/2013
JP 20014-006393 1/2014

* cited by examiner

*Primary Examiner* — Clayton E Laballe
*Assistant Examiner* — Fang-Chi Chang
(74) *Attorney, Agent, or Firm* — Cooper & Dunham LLP

(57) ABSTRACT

A developing device includes: a toner detection unit that detects whether there is toner that is stored; a stirring unit that stirs toner in a toner container; a calculation unit that calculates an output duty by comparing an output voltage of the toner detection unit representing whether there is toner after the stirring, with a predetermined voltage value; and a remaining amount detection unit that detects an amount of remaining toner at the output duty from a correspondence relationship between the output duty and an amount of remaining toner that is previously set.

10 Claims, 16 Drawing Sheets

CORRESPONDENCE TALE BETWEEN AMOUNT OF TONER REMAINING IN DEVELOPING UNIT AND SENSOR DUTY

| | FLOWABILITY =NORMAL | FLOWABILITY =POOR | FLOWABILITY =GOOD |
|---|---|---|---|
| REMAINING TONER AMOUNT [g] | SENSOR DUTY [%] | SENSOR DUTY [%] | SENSOR DUTY [%] |
| 60 | 62 OR UNDER | EQUAL TO OR UNDER 57 | EQUAL TO OR UNDER 67 |
| 70 | OVER 62, AND 68 OR UNDER | OVER 57, AND 63 OR UNDER | OVER 67, AND 73 OR UNDER |
| 80 | OVER 68, AND 73 OR UNDER | OVER 63, AND 68 OR UNDER | OVER 73, AND 78 OR UNDER |
| 90 | OVER 73, AND 82 OR UNDER | OVER 68, AND 77 OR UNDER | OVER 78, AND 87 OR UNDER |
| 100 | OVER 82, AND 93 OR UNDER 93 | OVER 77, AND 88 OR UNDER 88 | OVER 87, AND 98 OR UNDER 98 |
| 110 | OVER 93 | OVER 88 | OVER 98 |

OUTPUT WAVEFORM OF LIGHT RECEIVING ELEMENT (LESS TONER)

OUTPUT WAVEFORM OF LIGHT RECEIVING ELEMENT (MORE TONER)

CORRESPONDENCE TABLE BETWEEN AMOUNT OF TONER REMAINING IN DEVELOPING UNIT AND SENSOR DUTY

| REMAINING TONER AMOUNT [g] | SENSOR DUTY [%] |
|---|---|
| 60 | 62 OR UNDER |
| 70 | OVER 62, AND 68 OR UNDER |
| 80 | OVER 68, AND 73 OR UNDER |
| 90 | OVER 73, AND 82 OR UNDER |
| 100 | OVER 82, AND 93 OR UNDER |
| 110 | OVER 93 |

OUTPUT WAVEFORM OF LIGHT RECEIVING ELEMENT (TONER FLOWABILITY: NORMAL)

OUTPUT WAVEFORM OF LIGHT RECEIVING ELEMENT (TONER FLOWABILITY: POOR)

OUTPUT WAVEFORM OF LIGHT RECEIVING ELEMENT (TONER FLOWABILITY: GOOD)

FIG.9C

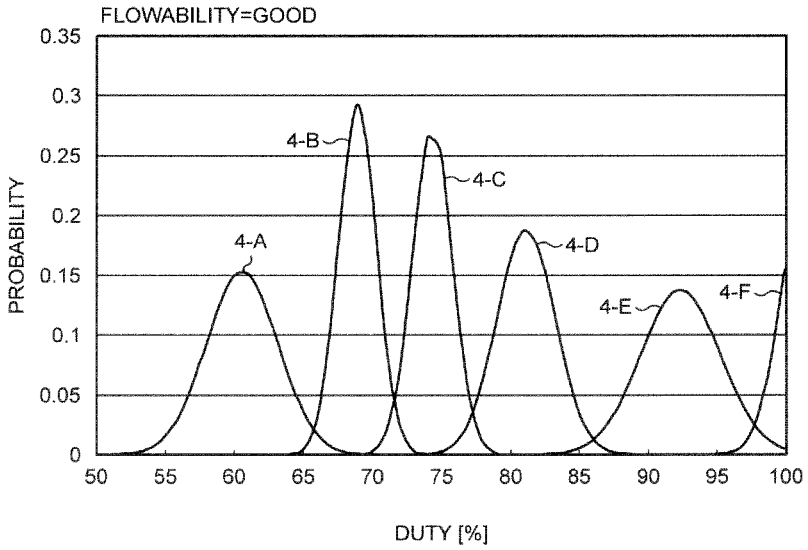

FIG.9D

CORRESPONDENCE TALE BETWEEN AMOUNT OF TONER REMAINING IN DEVELOPING UNIT AND SENSOR DUTY

| | FLOWABILITY =NORMAL | FLOWABILITY =POOR | FLOWABILITY =GOOD |
|---|---|---|---|
| REMAINING TONER AMOUNT [g] | SENSOR DUTY [%] | SENSOR DUTY [%] | SENSOR DUTY [%] |
| 60 | 62 OR UNDER | EQUAL TO OR UNDER 57 | EQUAL TO OR UNDER 67 |
| 70 | OVER 62, AND 68 OR UNDER | OVER 57, AND 63 OR UNDER | OVER 67, AND 73 OR UNDER |
| 80 | OVER 68, AND 73 OR UNDER | OVER 63, AND 68 OR UNDER | OVER 73, AND 78 OR UNDER |
| 90 | OVER 73, AND 82 OR UNDER | OVER 68, AND 77 OR UNDER | OVER 78, AND 87 OR UNDER |
| 100 | OVER 82, AND 93 OR UNDER 93 | OVER 77, AND 88 OR UNDER 88 | OVER 87, AND 98 OR UNDER 98 |
| 110 | OVER 93 | OVER 88 | OVER 98 |

FIG.13

CORRESPONDENCE TABLE BETWEEN TEMPERATURE VARIATION AND TONER FLOWABILITY

| TEMPERATURE | TONER FLOWABILITY |
|---|---|
| UNDER 20°C | GOOD |
| 20°C OR OVER, AND UNDER 25°C | NORMAL |
| 25°C OR OVER, AND UNDER 30°C | NORMAL |
| 30°C OR OVER, AND UNDER 35°C | NORMAL |
| 40°C OR OVER | POOR |

FIG.14

CORRESPONDENCE TABLE BETWEEN HUMIDITY VARIATION AND TONER FLOWABILITY

| HUMIDITY | TONER FLOWABILITY |
|---|---|
| UNDER 20°C | GOOD |
| 20% OR OVER, AND UNDER 30% | GOOD |
| 30% OR OVER, AND UNDER 40% | NORMAL |
| 40%OR OVER, AND UNDER 50% | NORMAL |
| 50% OR OVER, AND UNDER 60% | POOR |
| 60% OR OVER, AND UNDER 70% | POOR |
| 70% OR OVER | POOR |

FIG.15

CORRESPONDENCE TABLE BETWEEN HUMIDITY AND TEMPERATURE CHANGES AND TONER FLOWABILITY

| | | TEMPERATURE | | | | |
|---|---|---|---|---|---|---|
| | | UNDER 20°C | 20°C OR OVER, AND UNDER 25°C | 25°C OR OVER, AND UNDER 30°C | 30°C OR OVER, AND UNDER 35°C | 40°C OR OVER |
| HUMI-DITY | UNDER 20% | GOOD | GOOD | GOOD | GOOD | NORMAL |
| | 20% OR OVER, AND UNDER 30% | GOOD | GOOD | GOOD | NORMAL | NORMAL |
| | 30% OR OVER, AND UNDER 40% | GOOD | NORMAL | NORMAL | NORMAL | POOR |
| | 40% OR OVER, AND UNDER 50% | NORMAL | NORMAL | NORMAL | NORMAL | POOR |
| | 50% OR OVER, AND UNDER 60% | NORMAL | NORMAL | POOR | POOR | POOR |
| | 60% OR OVER, AND UNDER 70% | POOR | POOR | POOR | POOR | POOR |
| | 70% OR OVER | POOR | POOR | POOR | POOR | POOR |

FIG.16

PHOTOCONDUCTOR TRAVEL DISTANCE (TONER DETERIORATION DEGREE) AND TONER FLOWABILITY

| PHOTOCONDUCTOR TRAVEL DISTANCE | TONER FLOWABILITY |
|---|---|
| 0 m OR OVER, AND UNDER 50 m | GOOD |
| 50 m OR OVER, AND UNDER 100 m | GOOD |
| 100 m OR OVER, AND UNDER 150 m | NORMAL |
| 150 m OR OVER, AND UNDER 200 m | NORMAL |
| 200 m OR OVER | POOR |

DEVELOPING DEVICE, IMAGE FORMING APPARATUS, AND TONER DETECTION METHOD

CROSS-REFERENCE TO RELATED APPLICATIONS

The present application claims priority to and incorporates by reference the entire contents of Japanese Patent Application No. 2013-230720 filed in Japan on Nov. 6, 2013 and Japanese Patent Application No. 2014-197382 filed in Japan on Sep. 26, 2014.

BACKGROUND OF THE INVENTION

1. Field of the Invention

The present invention relates to a developing device, an image forming apparatus, and a toner detection method.

2. Description of the Related Art

A conventional electrographic image forming apparatus configured to supply toner from a toner container to a developing unit has to control the amount of toner to be supplied from the toner container to the developing unit. Remaining toner amount detection control is known in which, in order to control the amount of toner supply, a light transmission type sensor that detects the amount of toner in the developing unit is provided and, from the light transmission amount, the amount of toner remaining in the developing unit is measured.

In the remaining toner amount detection control where the light transmission type sensor is provided, a stirring paddle is provided on the optical path and the stirring paddle stirs the toner in the developing unit when remaining amount detection is performed. A configuration is known in which light is periodically blocked to clean the transparent members on the surfaces of the light emitting element and the light receiving element of the light transmission type sensor at a given cycle with a cleaning member that is provided on the stirring paddle.

In the above-descried configuration, light detection/non-detection by the light receiving element periodically changes because the light is blocked periodically. Regarding the light detection/non-detection, when an amount of remaining toner is large, the time during which no light is detected is long. On the other hand, when an amount of remaining toner is small, the time during which the light is detected is long. The control is known in which the amount of remaining toner is determined according to this time difference.

A means has been disclosed that, in order for accurate detection of the amount of toner remaining in a developing unit, includes a cleaning member that cleans a transmission window in a remaining amount detection method using a light transmission type sensor and determines an amount of remaining toner when the time during which a light receiving element of the light transmission type sensor detects light exceeds a given time (see, Japanese Laid-open Patent Publication No. 06-149055).

However, in the above-descried conventional configuration for detecting the amount of remaining toner using the light transmission type sensor and the cleaning member, the time during which the light receiving element detects or does not detect light varies depending on the flowability of the toner to be detected. In other words, in a state where toner is on the optical path, the cleaning member cleans the surface of the element and accordingly the toner on the optical path is raked out so that the optical path transmits light. The raked-out toner then goes back to the optical path again depending on its flowability so that light is blocked. If the toner has good flowability, because the toner goes back to the optical path soon after being raked out, the period during which light is transmitted shortens. On the other hand, if the toner has poor flowability, because the toner does not go back soon after being raked out, the period during which light is transmitted gets longer.

There is a problem that, because the toner flowability varies depending on the degree of deterioration of the toner and changes of the temperature and humidity, if such a change occurs, the amount of toner remaining in the developer cannot be detected accurately.

In view of the above circumstances, there is a need to implement accurate detection of the amount of toner remaining in the developing device.

SUMMARY OF THE INVENTION

It is an object of the present invention to at least partially solve the problems in the conventional technology.

A developing device includes: a toner detection unit that detects whether there is toner that is stored; a stirring unit that stirs toner in a toner container; a calculation unit that calculates an output duty by comparing an output voltage of the toner detection unit representing whether there is toner after the stirring, with a predetermined voltage value; and a remaining amount detection unit that detects an amount of remaining toner at the output duty from a correspondence relationship between the output duty and an amount of remaining toner that is previously set.

An image forming apparatus includes: a toner detection unit that detects whether there is toner that is stored; a stirring unit that stirs toner in a toner container; a calculation unit that calculates an output duty by comparing an output voltage of the toner detection unit representing whether there is toner after the stirring, with a predetermined voltage value; and a remaining amount detection unit that detects an amount of remaining toner at the output duty from a correspondence relationship between the output duty and an amount of remaining toner that is previously set.

A toner detection method is performed by a developing device including a toner detection unit that detects whether there is toner that is stored and a stirring unit that stirs toner in a toner container. The toner detection method includes: calculating an output duty by comparing an output voltage of the toner detection unit representing whether there is toner after the stirring, with a predetermined voltage value; and detecting an amount of remaining toner at the output duty from a correspondence relationship between the output duty and an amount of remaining toner that is previously set.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 9C is a graph representing the sensor duty to the amount of remaining toner with good toner flowability;

FIG. 9D is a correspondence table between the amount of toner remaining in the developing unit and the sensor duty;

FIG. 13 is an exemplary correspondence table between temperature variation and the toner flowability;

FIG. 14 is an exemplary correspondence table between humidity variation and the toner flowability;

FIG. 15 is an exemplary correspondence table between the temperature and humidity and the toner flowability; and FIG. 16 is an exemplary correspondence table between the distance that a photoconductor travels and the toner flowability.

DETAILED DESCRIPTION OF THE PREFERRED EMBODIMENTS

A developing device, an image forming apparatus, and a toner detection method according to an embodiment of the invention will be described in detail below with reference to the accompanying drawings.

Embodiment

The embodiment includes a light transmission type sensor for detecting the amount of toner remaining in a developing device and a cleaning member and, when determining the amount of remaining toner according to the time during which a light receiving element of the light transmission type sensor detects light, implements the following function: in accordance with the degree of deterioration of toner and changes of the temperature and humidity, changing the threshold of the time according to which a determination of the amount of remaining toner is made.

Figure 1:
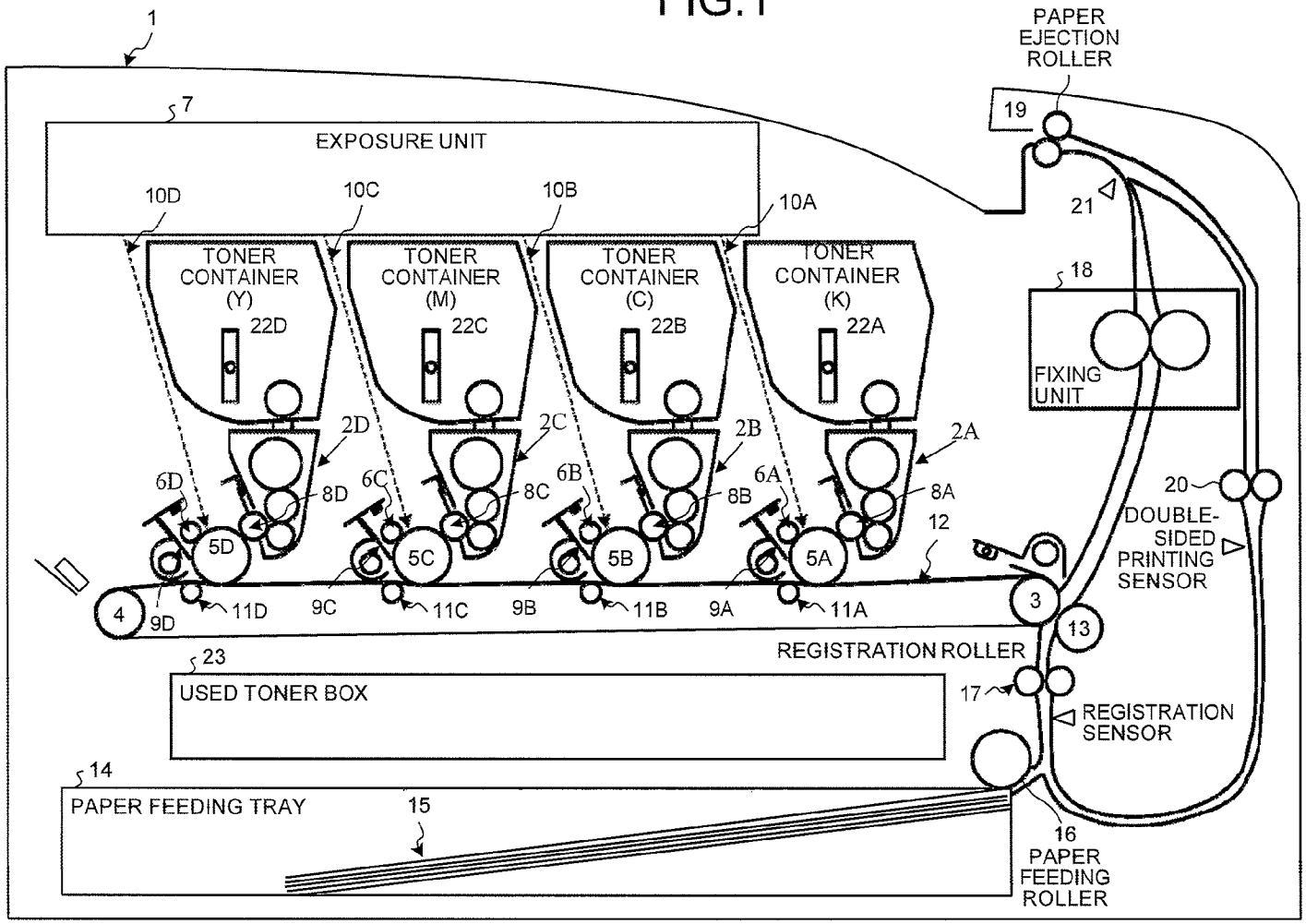
FIG. 1 illustrates an exemplary configuration of an image forming apparatus according to an embodiment.

FIG. 1 illustrates an exemplary configuration of the image forming apparatus according to the embodiment. As shown in FIG. 1, in an image forming apparatus 1, developing devices (image forming units) 2A, 2B, 2C, and 2D and toner containers 22A, 22B, 22C, and 22D of respective colors (Y, M, C and K) are arranged and provided along a transfer belt 12. The transfer belt 12 is an endless belt that is stretched around a secondary transfer drive roller 3 that is driven to rotate and a transfer belt tension roller 4. The developing device 2A includes a photoconductor 5A and a charger 6A, an exposure unit 7, a developing unit 8A, a cleaner blade 9A that are arranged around the photoconductor 5A. The developing devices 2A, 2B, 2C, and 2D are different only in the color (Y, M, C and K) of a toner image to be formed and have a common internal configuration.

The exposure unit 7 is configured to apply laser light 10A, 10B, 10C and 10D that is exposure light corresponding to the colors (Y, M, C and K) of images to be formed by the developing devices 2A, 2B, 2C and 2D, respectively.

The image forming apparatus 1 further includes a paper feeding tray 14 for stacking paper sheets 15, a paper feeding roller 16 for transferring a paper sheet 15, a registration roller 17, a paper ejection roller 19, and a double-sided printing roller 20. The image forming apparatus 1 further includes a secondary transfer roller 13 for transferring an image that is formed on the transfer belt 12 onto a paper sheet and a fixing unit 18 that fixes toner transferred onto the paper sheet. A paper ejection sensor 21 that detects that the paper sheet 15 passes is close to the paper ejection roller 19.

Furthermore, a waste toner box 23 for collecting a pattern formed on the transfer belt and the toner that is not transferred onto the paper sheet 15 and remains is arranged.

General operations performed by the image forming apparatus 1 constructed as described above will be described here. When forming an image, after being charged by the charger 6A in the dark, the outer circumference of the photoconductor 5A is exposed to the laser light 10A from the exposure unit 7 so that an electrostatic latent image is formed. The developing unit 8A turns the electrostatic latent image into a visible image with toner so that a toner image is formed on the photoconductor 5A. The toner image is transferred onto the transfer belt 12 at a position at which the photoconductor 5A and the transfer belt 12 make contact with each other (a primary transfer position) because of the action of the primary transfer roller 11A. The photoconductor 5A from which the toner image has been transferred waits for the next image forming after the unnecessary residual toner on its outer circumference is cleaned with the cleaner blade 9A.

The transfer belt 12 onto which the toner image is transferred by the developing device 2A is conveyed to the subsequent developing device 2B. The developing device 2B transfers a toner image such that the toner image is superimposed onto the image formed on the transfer belt 12 by the same process as the image forming process taken by the developing device 2A. The transfer belt 12 is further conveyed to the subsequent developing devices 2C and 2D and toner images are transferred and superimposed onto the transfer belt 12. In this manner, a full-color image is formed on the transfer belt 12. The transfer belt 12 on which a full-color image made up of superimposed images is formed is conveyed to the position of the secondary transfer roller 13.

Regarding paper conveying operations upon image forming, the paper feeding roller 16 is driven to rotate so that the paper sheets 15 stored in the paper feeding tray 14 are sequentially sent out from the top one. The registration roller 17 is started to be driven at a timing such that the position of the toner image conveyed by the transfer belt 12 and the position of the paper sheet 15 overlap each other on the secondary transfer roller 13. The registration roller 17 is driven to rotate counterclockwise so that the paper sheet 15 is sent out. Onto the paper sheet 15 that is sent out by the registration roller 17, the toner image on the transfer belt 12 is transferred by the secondary transfer roller 13. Thereafter, the fixing unit 18 fixes the toner image by heat and pressure and the paper sheet 15 is then ejected to the outside of the image forming apparatus 1 by the paper ejection roller 19 that is driven to rotate counterclockwise. A registration sensor that takes the paper conveying timing is provided on the conveying route just before the registration roller 17.

When performing double-sided printing, before the paper sheet 15 passes the paper ejection roller 19, the paper ejection roller 19 is driven to rotate clockwise so as to convey the paper sheet 15 to a double-sided printing conveying route. The paper sheet 15 conveyed to the double-sided printing conveying route is conveyed to the registration roller 17 again via the double-sided printing roller 20. The paper sheet 15 having reached the registration roller 17 is fed again from the registration roller 17 and a toner image is transferred by the secondary transfer roller 13 onto the surface of the paper sheet opposite to the surface on which the toner image is previously transferred. After the transfer, the fixing unit 18 fixes the toner image by heat and pressure and the paper sheet 15 is ejected to the outside of the image forming apparatus 1 by the paper ejection roller 19 that is driven to rotate counterclockwise. A double-sided printing sensor that takes the paper sheet conveying timing is provided on the double-sided printing conveying route.

A sensor (not shown) that detects whether the amount of toner is equal to or under a given amount is provided in each of the developing devices 2A, 2B, 2C and 2D. The sensor detects whether the amount of toner in the developing unit is equal to or under a given amount and toner is supplied from the toner containers 22A, 22B, 22C and 22D to the developing devices 2A, 2B, 2C and 2D.

Figure 2:
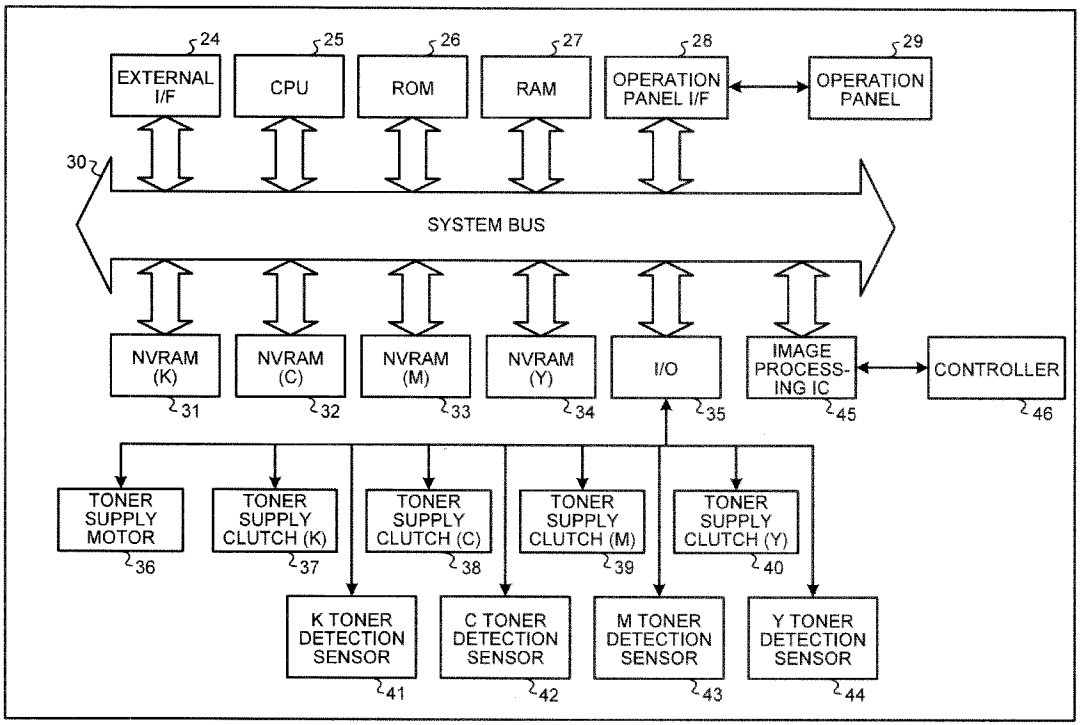
FIG. 2 is a block diagram of an exemplary configuration of the image forming apparatus according to the embodiment.

FIG. 2 is a block diagram of an exemplary configuration of the image forming apparatus according to the embodiment. A CPU (central processing unit) 25 generally controls accesses between various devices connected to a system bus 30 according to a control program stored in a ROM (read-only memory) 26 or the like. The CPU 25 controls inputs and outputs of electric devices including a sensor, a motor, a clutch, a heater (all not shown) that are connected via an I/O 35.

In other words, the ROM 26 stores the control program of the CPU 25 like one represented by the flowchart of FIG. 10, which will be described later. The CPU 25 executes the control program stored in the ROM 26. The CPU 25 is also communicable with external devices (not shown) including a host computer via an external I/F 24.

A RAM 27 is a RAM (random access memory) that serves as the main memory of the CPU 25, a work area, and/or the like and is used as an area for loading record data, an area for storing environmental data, and/or the like. NVRAMs 31, 32, 33, and 34 are mounted on the toner containers 22A, 22B, 22C and 22D, respectively, and store information, such as the amounts of toner remaining in the toner containers 22A, 22B, 22C and 22D. Using an operation panel 29 connected via an operation panel I/F 28, a printer mode and/or the like can be set.

By driving a toner supply motor 36 and turning on each toner supply clutch 37, 38, 39 or 40, toner of each color is supplied from each toner container to each developing unit. A K toner detection sensor 41, a C toner detection sensor 42, an M toner detection sensor 43, and a Y toner detection sensor 44 are provided in the developing devices 2A, 2B, 2C, and 2D, respectively, to detect whether there is a given amount of toner or more. Each of the K toner detection sensor 41, the C toner detection sensor 42, the M toner detection sensor 43, and the Y toner detection sensor 44 includes a light emitting element 47 and a light receiving element 48 (see FIG. 4) and performs detection of whether there is toner, which will be described later.

An image processing IC 45 receives image data from a controller 46 and transmits the image data for the laser light 10A, 10B, 10C and 10D. The image processing IC 45 has a function of calculating an amount of toner to be consumed per page from the image data received from the controller 46 and notifying the CPU 25 of the calculated amount of toner to be consumed via the system bus 30.

Because the developing devices 2A, 2B, 2C and 2D have the same configuration except that the developing devices 2A, 2B, 2C and 2D deal with colors (Y, M, C and K) that are different from one another, they are simply referred to as the developing device 2 or the developing devices 2A is described as an example as appropriate if there is no problem. This also applies to the descriptions of the photoconductors, the toner containers, and the toner detection sensors having the same configurations.

Figure 3:
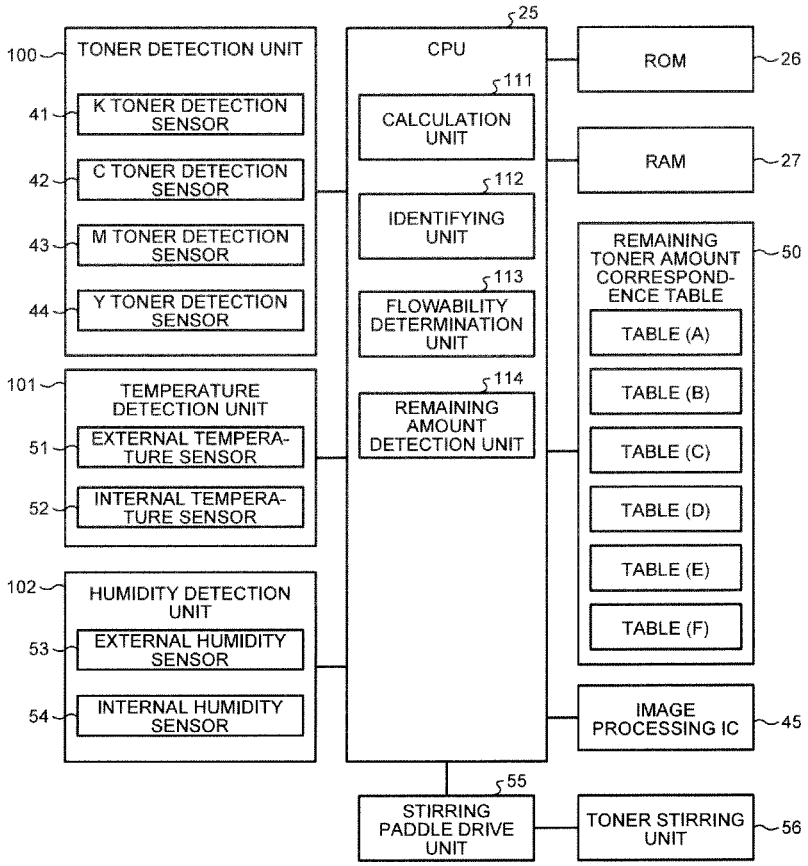
FIG. 3 is a block diagram of a functional configuration according to the embodiment.

FIG. 3 is a block diagram of a functional configuration according to the embodiment. The CPU 25 has the functions of a calculation unit 111, an identifying unit 112, a flowability determining unit 113, and a remaining amount detection unit 114, which will be described later.

Further, a remaining toner amount correspondence table 50 where the correspondence relationship between levels of toner flowability that are classified previously, the correspondence relationship between the levels of toner flowability and the output duty, and the amount of remaining toner is previously set is provided.

The CPU 25 is configured to be input with each detection output signal from each of a toner detection unit 100, a temperature detection unit 101, and a humidity detection unit 102. The toner detection unit 100 includes the K toner detection sensor 41, the C toner detection sensor 42, the M toner detection sensor 43, and the Y toner detection sensor 44. The temperature detection unit 101 includes an external temperature sensor 51 and an internal temperature sensor 52. The humidity detection unit 102 includes an external humidity sensor 53 and an internal humidity sensor 54.

The calculation unit 111 calculates an output duty by comparing the output voltage of the toner detection unit 100 representing whether there is toner after stirring by a toner stirring unit 56, with a predetermined voltage value. The remaining amount detection unit 114 detects the remaining toner amount at the output duty from the correspondence relationship between the predetermined toner remaining amount and the output duty.

The identifying unit 112 identifies the factor of variation of the toner flowability. The flowability determining unit 113 determines the level of toner flowability from the factor identified by the identifying unit 112. With reference to the remaining toner amount correspondence table 50, the remaining amount detection unit 114 identifies the amount of remaining toner from a combination corresponding to the toner flowability level that is determined by the flowability determining unit 113.

The remaining amount detection unit 114 also changes the result of the remaining toner amount detection from the output duty calculated by the calculation unit 111 and the toner flowability level. When the toner flowability level is poor, the remaining amount detection unit 114 changes the remaining toner amount to a remaining toner amount larger than that of when the toner flowability level is normal. The output duty is referred to as a sensor duty in the embodiment.

The identifying unit 112 identifies the factor of variation of the toner flowability on the basis of the result of temperature detection performed by the temperature detection unit 101. The identifying unit 112 identifies the factor of variation of the toner flowability also on the basis of the result of humidity detection performed by the humidity detection unit 102.

The identifying unit 112 identifies the factor of variation of the toner flowability also on the basis of the total time during which the developing device 2 is driven. For example, the developing device 2 is driven (rotated) by the driving system that drives the photoconductor 5, and the CPU 25 counts the time during which the photoconductor 5 is driven (rotated) and stores the time in a storage unit, such as the NVRAMs 31 to 34. The CPU 25 identifies the factor of variation of the toner flowability from the stored drive (rotation) time.

In the remaining toner amount correspondence table 50 as a storage unit, the tables of FIG. 6B, FIG. 9D and FIGS. 11 to 16, which are described later, are stored in tables (A) to (F) as data previously obtained by the experiment.

Instead of implementing each of the above-described functions by software (program) using the CPU 25, all of or a part of the functions may be implemented using a hardware circuit. In other words, all of or a part of the calculation unit 111, the identifying unit 112, the flowability determining unit 113, and the remaining amount detection unit 114 may be implemented using a hardware circuit.

Figure 4:
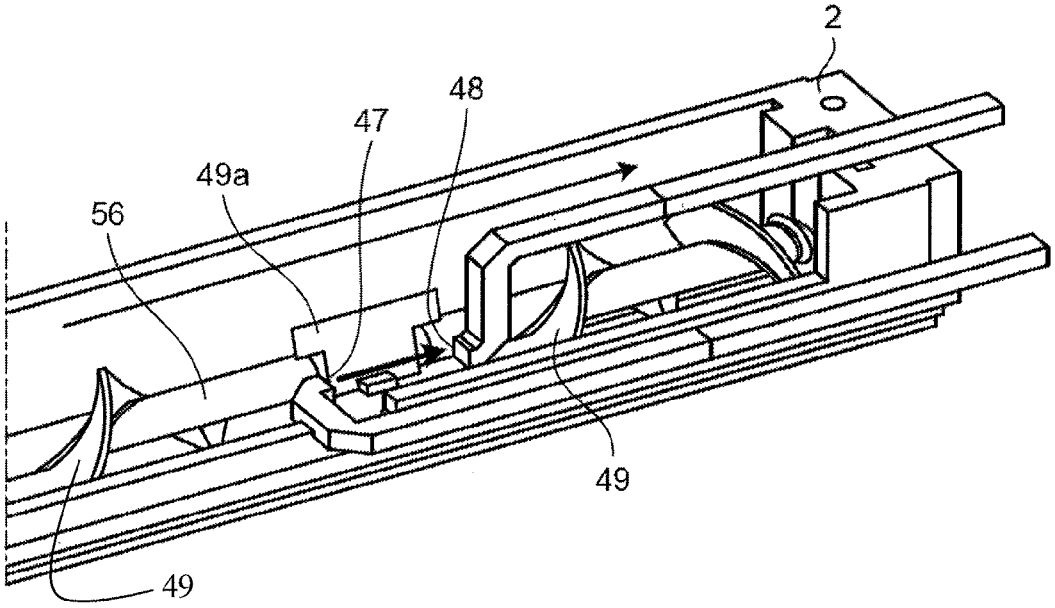
FIG. 4 illustrates an exemplary configuration of a toner stirring unit.
Figure 5A:
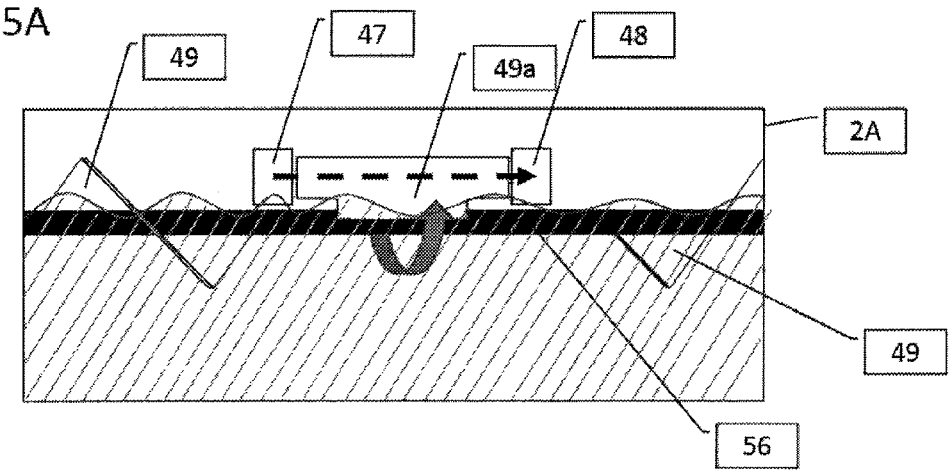
FIG. 5A illustrates an exemplary configuration for detection of the amount of toner remaining in a developing device using an optical sensor and illustrates a state where the amount of toner is small.

FIG. 4 illustrates an exemplary configuration of the toner stirring unit 56. The toner stirring unit 56 is provided with a stirring paddle (including multiple stirring paddle elements) 49 for stirring the toner in the developing device 2. A cleaning member 49*a* made of, for example, a thin polyester film is, as shown in FIG. 4, interposed between the stirring paddle elements and is attached to the stirring paddle 49 such that the cleaning member 49*a* makes contact with the light emitting surface of the light emitting element 47 and the light receiving surface of the light receiving element 48 with a micro pressure. The toner stirring unit 56 is rotated at a given timing by a stirring paddle drive unit 55 (see FIG. 3) to perform a toner stirring operation and clean the light emitting surface of the light emitting element 47 and the light receiving surface of the light receiving element 48. The positional relationship between the toner stirring mechanism and the toner sensor is satisfactory if the rotation axis of the stirring mechanism and the optical axis of the toner sensor are parallel or orthogonal to each other. FIG. 4 illustrates the mechanism parallel to the optical axis and FIGS. 5A and 5C illustrate the mechanism orthogonal to the optical axis. Both implement the same function. Although FIGS. 5A and 5C do not illustrate, the cleaning member 49*a* partly makes contact with the surfaces of the light emitting element 47 and the light receiving element 48.

Figure 5B:
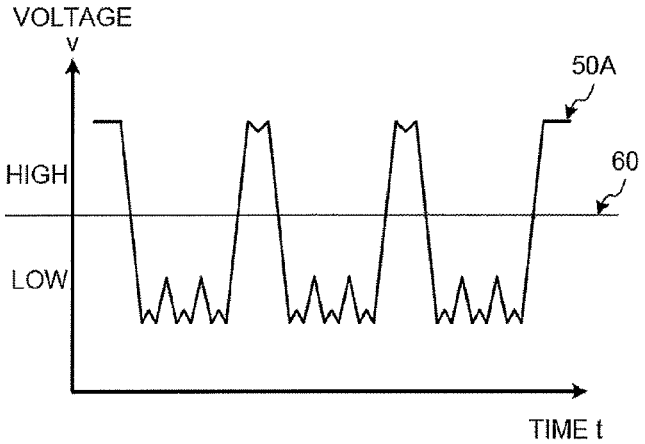
FIG. 5B is a graph representing the output waveform of a light receiving element in the state where the amount of toner is small shown in FIG. 5A.
Figure 5C:
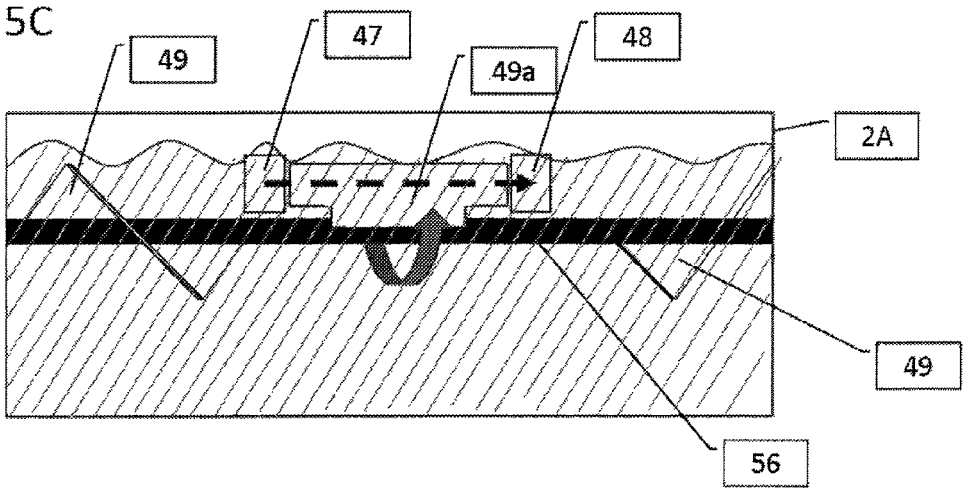
FIG. 5C illustrates an exemplary configuration for detection of the amount of toner remaining in the developing device using the optical sensor and illustrates a a state where the amount of toner is large.

FIGS. 5A to 5C illustrate exemplary configurations of detection of toner remaining in the developing device 2A, 2B, 2C or 2D using an optical sensor. The light emitting element 47 and the light receiving element 48 are attached to the inside of each of the developing devices 2A, 2B, 2C and 2D. The light emitted from the light emitting element 47 passes through the developing device 2A, 2B, 2C or 2D and is received by the light receiving element 48. If there is no toner on the optical path, the light is transmitted and, if there is toner, the light is blocked. The stirring paddle 49 (see FIG. 4) is located on the optical path and, when remaining toner amount detection is performed, the stirring paddle 49 stirs the toner in the developing device 2A, 2B, 2C or 2D. Because the cleaning member 49*a* provided on the stirring paddle 49 cleans the transparent members on the surfaces of the light emitting element 47 and the light receiving element 48 at a given cycle, the light is blocked periodically.

Figure 5D:
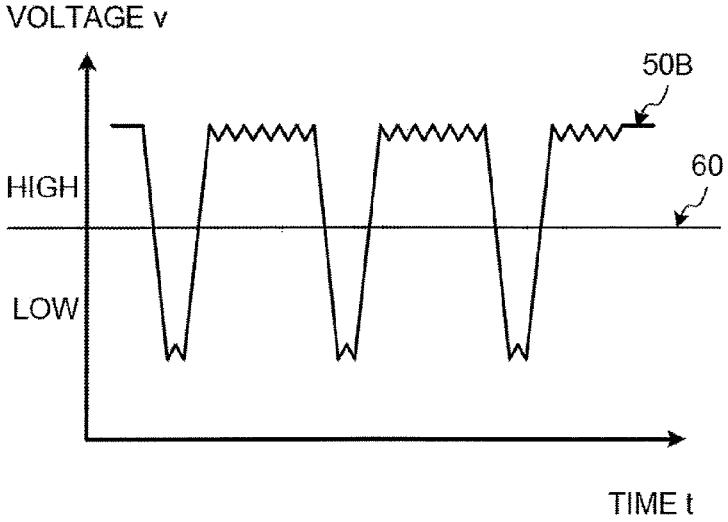
FIG. 5D is a graph representing the output waveforms of the light receiving element in the state where the amount of toner is large shown in FIG. 5C.

The signals shown in FIGS. 5B and 5D are output waveforms of the light receiving element 48 at a time when stirring in the developing device 2 is being performed. The output waveforms show a higher voltage value when the light is blocked and show a lower voltage value when the light is transmitted. The rate at which light is blocked changes depending on the amount of toner in the developing device 2 and accordingly the output waveform of the light receiving element 48 changes. If the amount of toner in the developing device 2 is small, the waveform of, for example, a signal 50A is obtained and, if the amount of toner in the developing device 2 is large, the waveform of, for example, a signal 50B is obtained. A threshold 60 is provided for the output value and, if the signal level is over the threshold 60, the voltage value is detected as a high value and, if the signal level is under the threshold 60, the voltage value is detected as a low value. The ratio of the number of times at which a high value is detected to the number of times at which a low value is detected per a certain period such as one second is defined as the sensor duty, and the amount of toner is detected from the sensor duty.

Figures 6A, 6B:
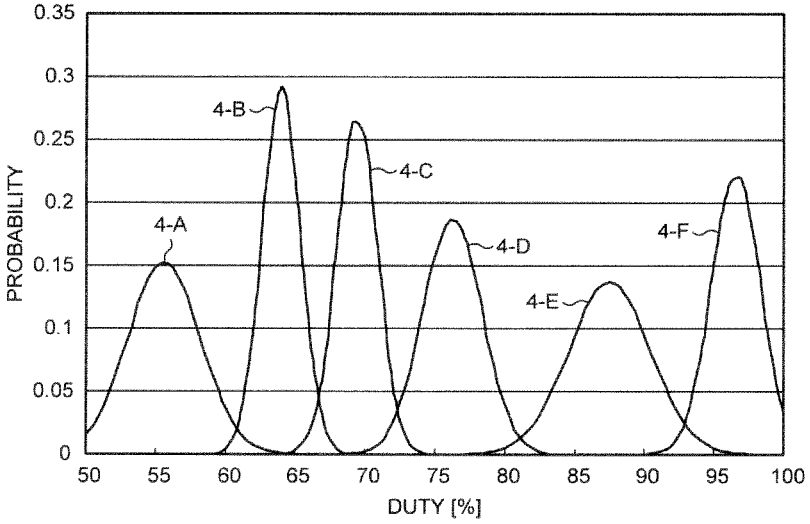
FIG. 6A is a graph representing the sensor duty corresponding to the amount of toner remaining in the developing unit.
FIG. 6B is a correspondence table between the amount of toner remaining in the developing unit and the sensor duty.

The sensor duty with respect to the amount of toner remaining in the developing device 2 will be described here with reference to FIGS. 6A and 6B. FIG. 6A represents the sensor duty corresponding to the amount of toner remaining in the developing device 2. FIG. 6A is a graph where 4-A corresponds to 60 g, 4-B corresponds to 70 g, 4-C corresponds to 80 g, 4-D corresponds to 90 g, 4-E corresponds to 100 g, and 4-F corresponds to 110 g. For example, 4-A represents a normal distribution of the sensor duty in a case where the amount of toner remaining in the developing device 2 is 60 g. Such data corresponding to the amount of toner remaining in each developing device 2 is previously measured and the sensor duty for determining the amount of toner remaining in the developing device 2 is determined. From the result of this determination, the correspondence relationship between the amount of toner remaining in the developing device 2 and the sensor duty is as shown in FIG. 6B.

Figure 7A:
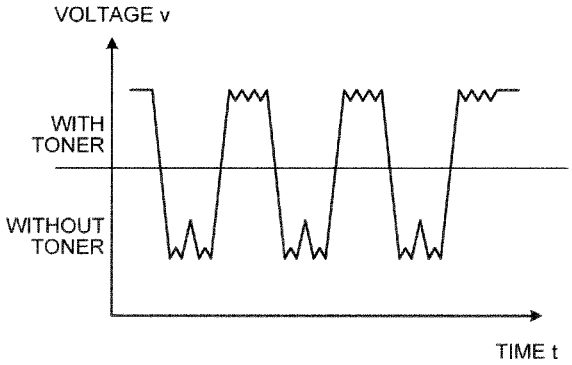
FIG. 7A is a graph representing the output waveform of the light receiving element with normal toner flowability.
Figure 7B:
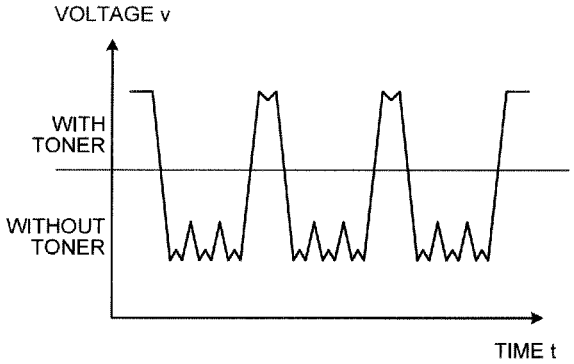
FIG. 7B is a graph representing the output waveform of the light receiving element with poor toner flowability.
Figure 7C:
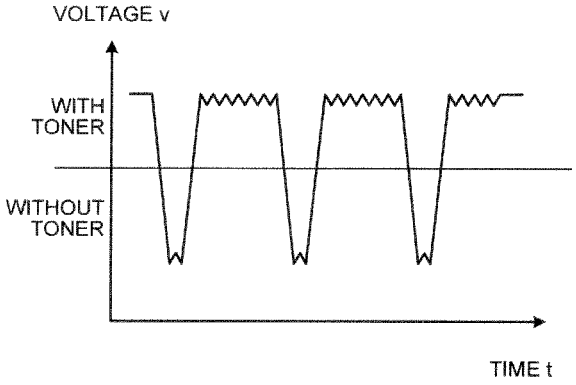
FIG. 7C is a graph representing the output waveform of the light receiving element with good toner flowability.

FIGS. 7A to 7C represent output waveform is of the light receiving element 48 resulting from detection of the amount of toner remaining in the developing device 2 using an optical sensor in a case where the toner flowability changes. The rate at which light is blocked changes depending on the flowability of toner in the developing device 2. For this reason, the output waveform of the light receiving element 48 changes and, if the flowability of the toner is poor compared to the case of FIG. 7A where the flowability of the toner in the developing device 2 is normal, the rate at which "there is no toner" is indicated increases as shown in FIG.

7B. On the other hand, if the toner flowability is good, the rate at which "there is toner" is indicated increases.

Change of the output waveform of the light receiving element 48 according to change of the toner flowability will be described in detail here. The output waveform of the light receiving element indicates that "there is no toner" when the toner on the optical path is raked out by the stirring paddle 49 and indicates that "there is toner" when the toner goes back to the optical path because of its flowability. For this reason, even if the amount of remaining toner is the same, in a case where the toner flowability is poor, the toner takes a longer time to go back to the optical path and accordingly the time during which the output waveform indicates that "there is no toner" gets longer. On the other hand, in a case where the toner flowability is good, the toner takes a shorter time to go back to the optical path and accordingly the time during which the output waveform indicates that "there is toner" gets longer.

Figure 8:
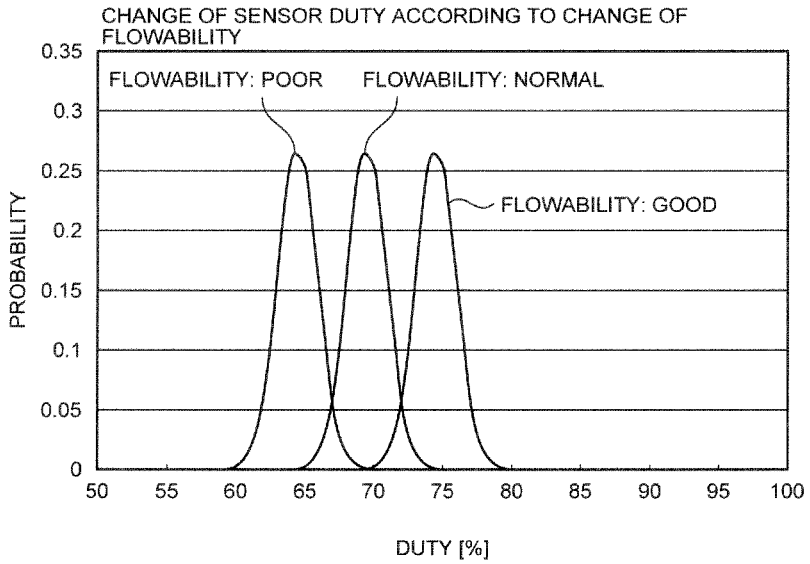
FIG. 8 is a graph representing change of the sensor duty due to change of the flowability at a certain amount of toner.

Change of the sensor duty according to change of the flowability will be described with reference to FIG. 8. The graph shown in FIG. 8 represents the sensor duty according to each level of flowability of a certain amount of toner in the developing device 2. Because, even if the amount toner is the same, the output waveform of the light receiving element 48 for detection of the amount of remaining toner changes according to the toner flowability, the position of the normal distribution of the sensor duty obtained from the output waveform also changes. Specifically, if the flowability is good compared to the normal case, the normal distribution of the sensor duty shifts to larger values and, if the flowability is poor compared to the normal case, the normal distribution of the sensor duty shifts to smaller values.

Examples of the factor of change of the toner flowability include the temperature, the humidity and the degree of toner deterioration.

Figure 11:
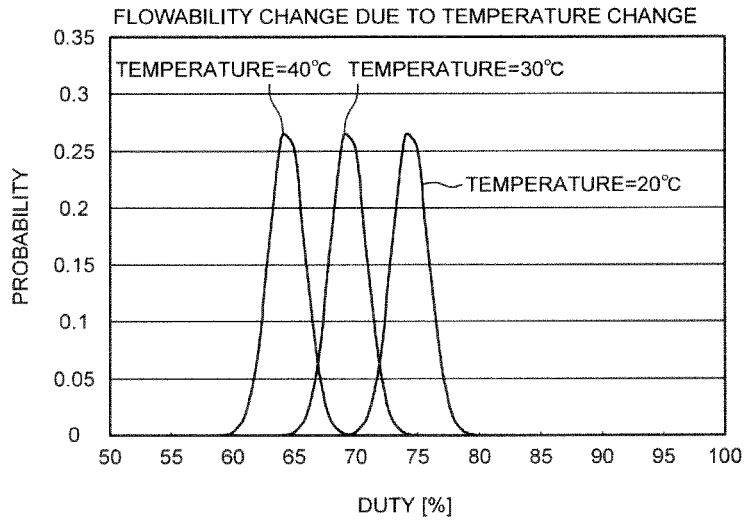
FIG. 11 is a graph representing the sensor duty corresponding to the temperature that is a factor of variation of the flowability at a constant amount of toner remaining in the developing unit.
Figure 12:
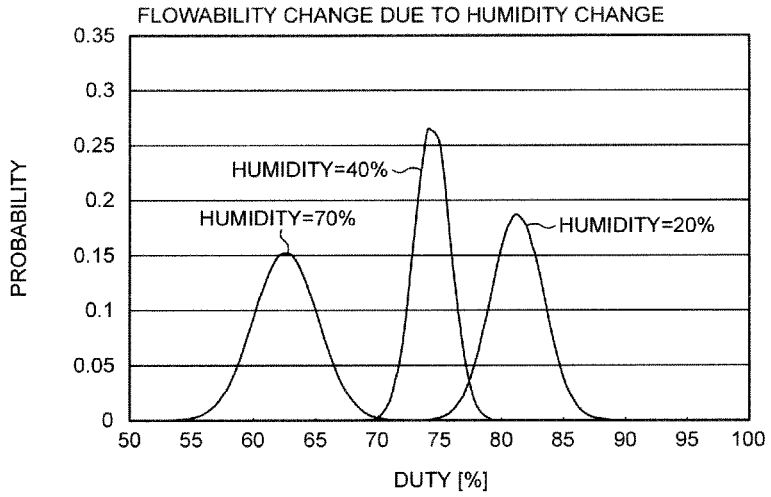
FIG. 12 is a graph representing the sensor duty corresponding to the humidity that is a factor of variation of the flowability at a constant amount of toner remaining in the developing unit.

A specific example of the factor of variation of the toner flowability will be descried here. FIG. 11 represents the sensor duty corresponding to the temperature that can be a factor of flowability variation in a state where an amount of toner remaining in the developing device 2 is constant. FIG. 12 represents the sensor duty corresponding to the humidity that can be a factor of flowability variation in a state where an amount of toner remaining in the developing unit 2 is constant.

For the temperature value, the temperature detected by the temperature detection unit 101 is used. In this case, it is previously determined, for the temperature value, which one of an average of the values of the external temperature sensor 51 and the internal temperature sensor 52, the highest value, and the temperature values from the external temperature sensor 51 and the internal temperature sensor 52 is used. For the temperature value, the humidity detected by the humidity detection unit 102 is used. In this case, it is previously determined, for the humidity value, which one of an average of the values from the external humidity sensor 53 and the internal humidity sensor 54, the highest humidity, and the humidity values from the external humidity sensor 53 and the internal humidity sensor 54 is used. The internal humidity sensor 54 is preferably provided near the developing device 2.

As shown in FIGS. 11 and 12, the peak position of the sensor duty in the normal distribution graph changes according to the variation of the temperature and humidity. How the toner flowability changes is determined with reference to the results of detection performed by the temperature detection unit 101 and the humidity detection unit 102 when what amount of change of the sensor duty occurs is defined as shown in FIGS. 13 to 15.

FIG. 13 is an exemplary correspondence table between temperature variation and toner flowability. FIG. 14 is an exemplary correspondence table between humidity variation and toner flowability. When the toner flowability is determined according to multiple factors, a correspondence table like the one shown in FIG. 15 is defined. The identifying unit 112 identifies the toner flowability using the correspondence tables when "check on flowability variation factor and flowability" at step S13 shown in FIG. 10 is performed.

According to the exemplary correspondence table between the temperature variation and toner flowability shown in FIG. 13, the correspondence between the temperature and toner flowability is set as follows: for example, the toner flowability is good when the temperature is under 20° C., the toner flowability is poor when the temperature is 40° C. or over, and the toner flowability is normal when the temperature is between those temperatures.

According to the exemplary correspondence table between the humidity variation and toner flowability, the correspondence between the humidity and toner flowability is set as follows: for example, the toner flowability is good when the humidity is under 20% or when the humidity is 20% or over 20% and under 30%, the toner flowability is poor when the humidity is 50% or over, and the toner flowability is normal when the humidity is between the above humidity values.

The correspondence table shown in FIG. 15 represents a correspondence relationship obtained by combining the correspondence to the temperature shown in FIG. 13 and the correspondence to the humidity shown in FIG. 14. The identifying unit 112 determines the toner flowability with reference to those correspondence tales. According to FIG. 15, "NORMAL", "GOOD" AND "POOR" are set according to the temperature value and the humidity value as the criterion to determine the toner flowability.

For the degree of deterioration of the toner stored in the developing device 2 and/or the like, a correspondence table corresponding to the toner flowability is created and is used as data for the identifying unit 112 to identify the toner flowability. When there are three or more types of factors of toner flowability variation, for example, a table like the one shown in FIG. 15 is created and is used to determine the factor of toner flowability variation.

The degree of toner deterioration is determined from the distance that the photoconductor 5 travels after toner is supplied from the toner container 22 to the developing device 2 for the last time. As the travel distance is longer, the time during which the toner is stirred in the developing device 2 is longer and the toner deteriorates due to a mechanical stress and/or the like applied onto the toner. For example, because the developing device 2 is driven (rotated) by the drive system that drives the photoconductor 5, the distance that the photoconductor 5 travels is measured by counting the time during which the photoconductor 5 is driven (rotated) and is used as data for the identifying unit 112 to identify the toner flowability.

According to the correspondence table shown in FIG. 16, the photoconductor travel distance and toner flowability are set as follows: for example, the toner flowability is good when the photoconductor travel distance is 0 m or over 0 m and under 50 m, or is 50 m or over 50 m and under 100 m, the toner flowability is poor when the photoconductor travel distance is 200 m or over, and the toner flowability is normal when the photoconductor travel distance is between these photoconductor travel distances.

Figure 9A:
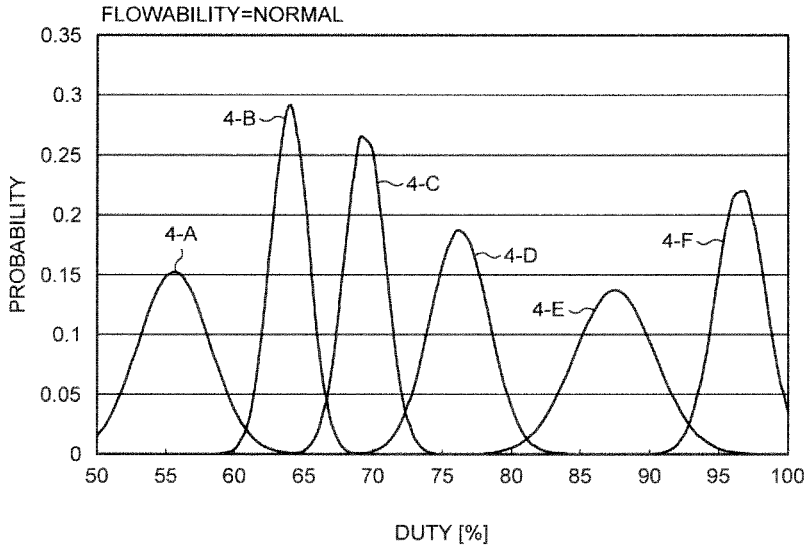
FIG. 9A is a graph representing the sensor duty to the amount of remaining toner with normal toner flowability.
Figure 9B:
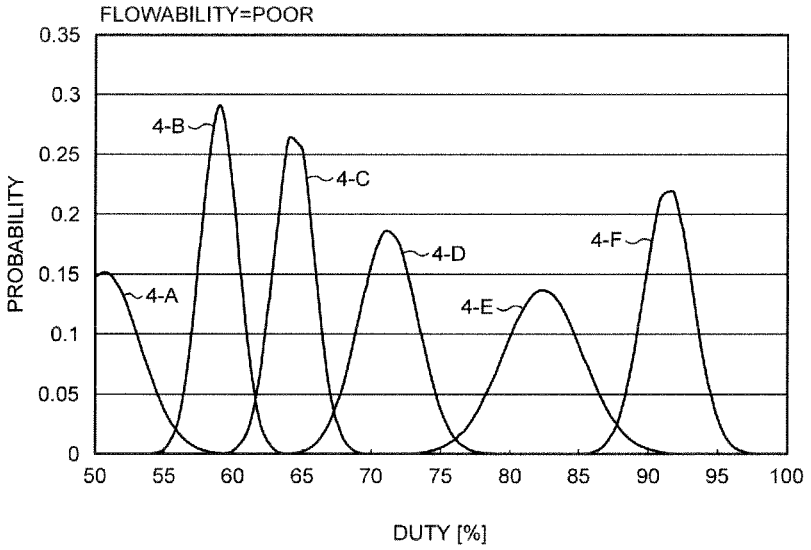
FIG. 9B is a graph representing the sensor duty to the amount of remaining toner with poor toner flowability.

The sensor duty with respect to the amount of toner remaining in the developing device 2 in a case where the toner flowability changes will be described here with reference to FIGS. 9A to 9D. The graphs of FIGS. 9A to 9C represent the sensor duty corresponding to the amount of toner remaining in the developing device 2 according to the toner flowability. FIG. 9A represents the case where the toner flowability is normal, FIG. 9B represents the case where the toner flowability is poor, and FIG. 9C represents the case where the toner flowability is good.

In these graphs, 4-A corresponds to 60 g, 4-B corresponds to 70 g, 4-C corresponds to 80 g, 4-D corresponds to 90 g, 4-E corresponds to 100 g, and 4-F corresponds to 110 g. In accordance with the change (normal, poor, good) of the toner flowability, the peak position of the sensor duty in the normal distribution graph changes.

Specifically, it can be seen that, even if the amount of remaining toner is the same, the normal distribution of the sensor duty with poor toner flowability is at a position lower than that with normal toner flowability (e.g., regarding the graph 4-B corresponding to the amount of remaining toner is 70 g, while the peak is at about 64% with normal flowability, the peak is at about 58% with poor flowability). On the other hand, it can be seen that the normal distribution of the sensor duty with good toner flowability is at a position higher than that with the normal toner flowability (e.g., regarding the graph 4-B corresponding to the amount of remaining toner is 70 g, while the peak is at about 64% with normal flowability, the peak is at about 69% with good flowability).

These results lead to the correspondence table of FIG. 9D between the amount of toner remaining in the developing device 2 and the sensor duty. FIG. 9D represents the amount of remaining toner corresponding to the sensor duty for each of cases of the normal, poor, and good toner flowability.

Figure 10:
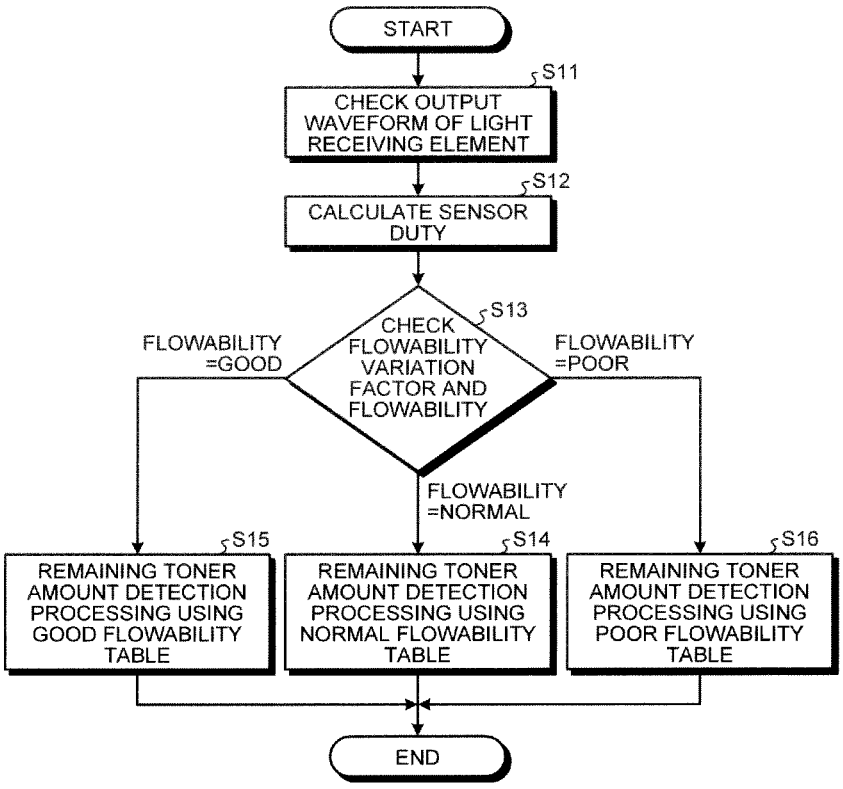
FIG. 10 is a flowchart of exemplary operations for controlling detection of the amount of remaining toner.

FIG. 10 is a flowchart of exemplary operations for controlling detection of the amount of remaining toner. The control operations are generally performed by the CPU 25. As shown in FIG. 10, once detection of the amount of remaining toner is started, the output waveform of the light receiving element 48 of the sensor is checked (step S11). The calculation unit 111 then calculates a sensor duty between the number of times for which the sensor detects a high value and the number of times for which the sensor detects a low value (step S12). When the sensor duty calculation completes, the identifying unit 112 checks the factor of toner flowability variation and the flowability determining unit 113 determines the current toner flowability (step S13). Here, the remaining amount detection unit 114 detects the amount of remaining toner according to the identified normal, good, or poor toner flowability at steps S14, S15 or S16. In other words, according to the toner flowability, the amount of remaining toner is detected from the table shown in FIG. 9D, which is the table stored in the remaining toner amount correspondence table 50.

The remaining amount detection unit 114 performs the detection processing according to the table of FIG. 9D. For example, the case where the sensor duty is 70% and the toner flowability is poor corresponds to "OVER 68, AND 77 OR UNDER" and, accordingly, the remaining amount detection unit 114 detects that the amount of remaining toner is 90 g; and the case where the sensor duty is 70% and the toner flowability is good corresponds to "OVER 67, AND 73 OR UNDER" and, accordingly, the remaining amount detection unit 114 detects that the amount of remaining toner is 70 g.

The above-descried embodiment includes the light transmission type sensor and the cleaning member to detect the amount of toner remaining in the developing device 2 and, according to the time during which the light receiving element of the light transmission type sensor detects light, determines the amount of remaining toner. In such a configuration, because the threshold of the time for determining the amount of remaining toner is changed according to the degree of deterioration of toner and change of the temperature and humidity, even if the toner flowability changes, the amount of toner remaining in the developing device 2 can be detected accurately.

The program executed in the embodiment is previously installed in the ROM 26 and provided. Alternatively, the program executed in the embodiment may be recorded in a computer-readable recording medium and provided as a computer program product. For example, the program may be recorded in an installable format or an executable file in a computer-readable recording medium, such as a CD-ROM, a flexible disk (FD), a CD-R, or a DVD (Digital Versatile Disc), and provided.

The program that is executed in the embodiment may be stored in a computer connected to a network, such as the Internet, and may be downloaded to be provided via the network. Alternatively, the program that is executed in the embodiment may be provided or distributed via a network, such as the Internet.

The program in the ROM 26 that is executed in the embodiment implements a module including the calculation unit 111, the identifying unit 112, the flowability determining unit 113, and the remaining amount detection unit 114. Regarding practical hardware, the CPU 25 (processor) reads the program from the recording medium and executes the program so that each of the above-described units is loaded into the main storage device, such as the RAM 27. The program is generated in the main storage device.

According to an aspect of the embodiment, the amount of toner remaining in the developing device can be detected accurately.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device comprising:

a toner container disposed in the developing device;

a toner detection unit to detect whether there is toner that is stored;

a light emitting element provided in the toner detection unit to emit light for detecting presence or absence of the toner in the toner detection unit;

a light receiving element provided in the toner detection unit to receive the light emitted from the light emitting element;

a stirring unit that stirs toner in the toner container; a calculation unit that calculates an output duty by comparing an output voltage of the toner detection unit obtained based on output of the light receiving element, representing whether there is toner after stirring, with a predetermined voltage value;

a flowability determining unit that determines level of toner flowability based on factor of variation of toner flowability;

a storage unit that stores a table including plural subtables corresponding to plural respective levels of flowability, each sub-table amongst the plural sub-tables representing, for a corresponding level of flowability, a correspondence relationship that is previously set, between sensor duty and an amount of remaining toner at the corresponding level of flowability; and a remaining amount detection unit that detects an amount of remaining toner at the output duty by referring to (i) a selected sub-table, amongst the plural sub-tables, which corresponds to (ii) the level of toner flowability determined by the flowability determining unit, at the output duty calculated by the calculation unit based on a current output of the light receiving element.

2. The developing device according to claim 1, further comprising:

an identifying unit that identifies a factor of variation of toner flowability, wherein the flowability determining unit determines the level of toner flowability based on the factor of variation of toner flowability identified by the identifying unit.

3. The developing device according to claim 2, wherein the remaining amount detection unit changes result of detecting the amount of remaining toner depending on the calculated output duty and the level of toner flowability.

4. The developing device according to claim 2, wherein, when the level of toner flowability is poor, the remaining amount detection unit changes the amount of the remaining toner to an amount of remaining toner larger than that of when the level of toner flowability is normal.

5. The developing device according to claim 2, wherein the identifying unit identifies the factor of variation of the toner flowability on the basis of result of temperature detection by a temperature sensor.

6. The developing device according to claim 2, wherein the identifying unit identifies the factor of variation of the toner flowability on the basis of result of humidity detection by a humidity sensor.

7. The developing device according to claim 2, wherein the identifying unit identifies the factor of variation of the toner flowability on the basis of a total time during which the developing device is driven.

8. The developing device according to claim 1, further comprising:

a pair of stirring paddle elements each arranged on a shaft of the stirring unit to rotate about a rotational axis of the shaft, the stirring paddle elements being disposed at respective different positions in an axial direction along the shaft; and a cleaning member arranged on the shaft at a position interposed along the axial direction of the shaft between the pair of stirring paddle elements, the cleaning member rotating about the shaft, to periodically block the light receiving element from receiving the light emitted from the light emitting element in a distance shorter than a length in a length direction of the developing device, and the output duty calculated by the calculation unit reflecting the periodic blockage by the rotating cleaning member.

9. An image forming apparatus comprising:

a photoconductor including a surface on which an electrostatic latent image is formed by exposure to light;

a developing unit to apply toner to convert the electrostatic latent image into a visible toner image, the visible toner image having been transferred from the surface of the photoconductor by a transfer unit external to the developing unit;

a toner container disposed in the developing unit;

a toner detection unit disposed in the developing unit to detect whether there is toner that is stored in the toner container;

a light emitting element provided in the toner detection unit to emit light for detecting presence or absence of the toner in the toner detection unit;

a light receiving element provided in the toner detection unit to receive the light emitted from the light emitting element;

a stirring, unit that stirs toner in the toner container; a calculation unit that calculates an output duty by comparing an output voltage of the toner detection unit obtained based on output of the light receiving element, representing whether there is toner after stirring, with a predetermined voltage value;

a flowability determining unit that determines level of toner flowability based on factor of variation of toner flowability;

a storage unit that stores a table including plural sub-tables corresponding to plural respective levels of flowability, each sub-table amongst the plural sub-tables representing, for a corresponding level of flowability, a correspondence relationship that is previously set, between sensor duty and an amount of remaining toner at the corresponding level of flowability; and a remaining amount detection unit that detects an amount of remaining toner at the output duty by referring to (i) a selected sub-table, amongst the plural sub-tables, which corresponds to (ii) the level of toner flowability determined by the flowability determining unit, at the output duty calculated by the calculation unit based on a current output of the light receiving element.

10. A method performed by a developing device including a toner detection unit that detects whether there is toner that is stored and a stirring unit that stirs toner in a toner container, the toner detection method comprising:

(a) receiving by a light receiving element provided in the toner detection unit light emitted from a light emitting element provided in the toner detection unit;

(b) calculating an output duty by comparing an output voltage of the toner detection unit obtained based on output of the light receiving element, representing whether there is toner after stirring, with a predetermined voltage value;

(c) determining level of toner flowability based on factor of variation of toner flowability;

(d) storing a table including plural sub-tables corresponding to plural respective levels of flowability, each sub-table amongst the plural sub-tables representing, for a corresponding level of flowability, a correspondence relationship that is previously set, between sensor duty and an amount of remaining toner at the corresponding level of flowability; and (e) detecting an amount of remaining toner at the output duty, by referring to (i) a selected sub-table, amongst the plural sub-tables, which corresponds to (ii) the level of toner flowability determined in (c), at the output duty calculated in (b) based on a current output of the light receiving element.

* * * * *